US005323911A

United States Patent [19]

Johnston et al.

[11] Patent Number: 5,323,911

[45] Date of Patent: Jun. 28, 1994

[54] PALLETIZED CONTAINER HAVING DISCRETE COMPARTMENTS FORMED BY DIVIDERS

[75] Inventors: James B. Johnston, Roseville; Christopher J. Rufer, Sacramento; Gordon K. Gardner, Jr., Los Banos; Joseph Pimentel, Jr., Gustine; Verdis Upton, III, Woodland, all of Calif.

[73] Assignee: The Morning Star Packing Co., Woodland, Calif.

[21] Appl. No.: 944,126

[22] Filed: Sep. 11, 1992

[51] Int. Cl.[5] ..... B65D 19/06

[52] U.S. Cl. ..... 206/600; 206/526; 220/403; 220/410; 220/462; 220/507; 220/552; 229/120.34

[58] Field of Search ..... 220/410, 462, 403, 507, 220/509, 552; 206/386, 600, 526; 229/120.34, 198.1

[56] References Cited

U.S. PATENT DOCUMENTS

| | | | |
|---|---|---|---|
| 279,199 | 6/1883 | Stevens | 229/120.34 |
| 1,940,309 | 12/1933 | Lackey | 229/198.1 |
| 2,260,424 | 10/1941 | Waters | 220/463 X |
| 2,349,364 | 5/1944 | Marshall, Jr. | 229/120.34 X |
| 2,534,010 | 12/1950 | Frye . | |
| 2,534,011 | 12/1950 | Frye . | |
| 2,683,010 | 7/1954 | Hamerslag, Jr. . | |
| 2,700,521 | 1/1955 | Lapham . | |
| 2,713,962 | 7/1955 | Camp et al. | 229/120.34 X |
| 3,176,898 | 4/1965 | Seger, Jr. | 229/120.34 X |
| 4,054,223 | 10/1977 | Marques . | |
| 4,221,296 | 9/1980 | Fell et al. . | |
| 4,318,475 | 3/1982 | Robinson | 206/526 X |
| 4,324,333 | 4/1982 | Porter | 206/386 X |
| 4,426,015 | 1/1984 | Preston et al. . | |
| 4,454,946 | 6/1984 | Yokowo . | |
| 4,499,997 | 2/1985 | Swingley, Jr. | 220/552 X |
| 4,516,692 | 5/1985 | Croley . | |
| 4,697,699 | 10/1987 | Schneider . | |
| 4,763,787 | 8/1988 | Koenig . | |
| 4,786,192 | 11/1988 | Graves et al. . | |
| 4,949,898 | 8/1990 | Nederveld . | |
| 5,036,979 | 8/1991 | Selz . | |

FOREIGN PATENT DOCUMENTS

| | | | |
|---|---|---|---|
| 1066615 | 4/1967 | United Kingdom | 220/552 |

OTHER PUBLICATIONS

Beatrice/Hunt-Wesson; "Bag-in-Bin Tomato Paste" Brochure; no date.

American Plywood Association; "Slim Bin" Brochure; 1991.

*Primary Examiner*—Bryon P. Gehman

*Attorney, Agent, or Firm*—Bernhard Kreten

[57] ABSTRACT

A collapsible, palletized bin container is provided which has separate compartments therewithin. Each compartment is designed to house a separate fluid-filled bag. Dividers are located within the container which form the discrete compartments. Each divider has tabs which are received within notches in sidewalls of the container. The notches allow the sidewalls to bow slightly outward while still maintaining a tight seal with the tabs. The container is collapsible to a substantially smaller volume for transport when empty and a bar, chain and hook assembly is provided for easy removal of the fluid-filled bags when sliding the bags out of the compartments of the container.

31 Claims, 5 Drawing Sheets

PALLETIZED CONTAINER HAVING DISCRETE COMPARTMENTS FORMED BY DIVIDERS

FIELD OF THE INVENTION

The following invention relates to collapsible storage containers having a palletized base for storage and transportation of liquids. More particularly, this invention relates to collapsible palletized containers having dividers which subdivide the container into separate regions.

BACKGROUND OF THE INVENTION

Containers are commonly used in storage and transportation of viscous liquids, such as tomato paste and other food products. These containers are often palletized and have rigid walls and a lid which support a bag filled with the fluid to be contained. Commonly, these containers are collapsible when empty so that they require less space for storage and transport. The container must be strong enough to survive the rigors of transportation and yet be easily stackable to maximize warehouse space. Standard sizes of forklifts, highway freight trailers, railroad cars, and other shipping containers have resulted in the proliferation of containers which have a footprint similar to that of a standard 44-inch by 48-inch pallet and having a height of approximately 37 inches. Containers which deviate significantly from these dimensions are less economical in that they do not fit as easily onto various transportation systems and are not as easily manipulated by commonly available handling means, such as,forklifts.

Containers of this size hold approximately 300 gallons of fluid. While this size can be easily handled by many industrial customers, a significant portion of the industrial customers can not handle such large quantities of fluids in their facilities. Many users of tomato paste, for example, prefer to receive paste in 55-gallon increments such as are commonly contained in 55-gallon drums. Drums are inherently less efficient in storage and transportation than are the palletized 300-gallon containers.

Drums leave excess space when placed within a warehouse or on a transportation device. Furthermore, drums are not collapsible as are the 300-gallon containers. Accordingly, a need exists for providing the convenience and cost effectiveness of a container similar to the collapsible 300-gallon type, which contains the fluid in discrete 55-gallon increments as is required by many industrial customers. The invention of this application meets this need by providing a collapsible container having exterior dimensions substantially similar to those of 300-gallon containers but which is subdivided into four separate 55-gallon regions, each region receiving a 55-gallon bag of fluid therein.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| INVENTOR | U.S. Pat. No. | ISSUE DATE |
|---|---|---|
| Frye, De Moine H. | 2,534,010 | December 12, 1950 |
| Frye, De Moine H. | 2,534,011 | December 12, 1950 |
| Hamerslag, J. P. Jr. | 2,683,010 | July 6, 1954 |

-continued

| INVENTOR | U.S. Pat. No. | ISSUE DATE |
|---|---|---|
| Lapham, S. D. | 2,700,521 | January 25, 1955 |
| Marques, et al. | 4,054,223 | October 18, 1977 |
| Fell, et al. | 4,221,296 | September 9, 1980 |
| Preston, et al | 4,426,015 | January 17, 1984 |
| Yokowo, K. | 4,454,946 | June 19, 1984 |
| Croley, T. | 4,516,692 | May 14, 1985 |
| Schneider, W. | 4,697,699 | October 6, 1987 |
| Koenig, D. | 4,763,787 | August 16, 1988 |
| Graves, et al. | 4,786,192 | November 22, 1988 |
| Nederveld | 4,949,898 | August 21, 1990 |
| Selz | 5,036,979 | August 6, 1991 |

The brochure presented by Beatrice/Hunt-Wesson (undated) for the bag-in-bin container teaches the use of a collapsible palletized container which receives a bag filled with fluid (such as tomato paste) on an interior thereof. The instant invention is both structurally distinguishable from this reference and further provides dividers on an interior thereof which segregate the interior into four separate regions, with each region receiving a separate bag of fluid.

Many of the listed prior art, of which the patent to Preston, et al. is an example, teach a container which may be palletized, is collapsible and receives a bag filled with fluid therein. The application of this invention is distinguishable structurally from devices of this type and also in that, inter alia, it divides the interior of the container into four separate regions and provides a separate bag filled with fluid for each region.

Another group of prior art, of which the patent to Yokowo is an example, teach the use of collapsible containers which are subdivided into separate regions and which are palletized. The device of this invention is distinguishable from the teachings of these patents in that, inter alia, the dividing walls within the container of this invention are securely fastened to sidewalls of the container. This insures that, if one region within the container is empty and an adjacent region within the container is full, the container will maintain its integrity and be able to restrain the fluid within the bag from displacing the dividers within the containers. Furthermore, none of these references contemplate storage of liquid filled bags therein.

Those prior art citations which do not fit into either of these categories, diverge even more starkly from the instant invention than do those inventions fitting into the groups specifically distinguished above.

SUMMARY OF THE INVENTION

The collapsible palletized bin container of this invention provides a highly efficient means for transporting fluids in discrete increments smaller than the total volume of conventional unpartitioned palletized containers. This container has discrete compartments which can separately house fluids therewithin. This structure favors use by food processors, for example, which utilize smaller quantities of raw ingredients for each batch created. However, the container as a whole has a traditional exterior shape which is conducive to vertical stacking and which can be efficiently grouped adjacent other identical containers in a warehouse such that forklifts or other devices can easily transport the containers.

In general, the container includes a standard pallet for a base. A flat platform rests upon an upper surface of the pallet which forms a floor of the container. Four sidewalls extend vertically upward from edges of the pallet surrounding the platform. Two of the sidewalls have L-brackets riveted thereto which are located on vertical side edges of the sidewalls. These sidewalls are oriented opposite each other upon the pallet. The two remaining sidewalls are oriented opposite each other and between the sidewalls with the L-brackets.

Two dividers are vertically oriented inside the sidewalls and interrelated to form a cross-shaped structure. One "bottom" divider is a substantially planar rectangular construct which has a vertical slit extending from a top edge of the bottom divider to a central location of the bottom divider. One "top" divider is a substantially planar rectangular construct which has a slit extending from a bottom edge of the top divider to a central location of the top divider. The two slits are sized to allow the two dividers to fit together with top edges of each divider in a horizontal plane and bottom edges of the two dividers in a horizontal plane. The two dividers are oriented perpendicular to each other with their bottom edges resting on the top surface of the platform. A cardboard liner may be interposed therebetween.

Side edges of the dividers are oriented adjacent the sidewalls. Each side edge of the dividers has two tabs extending therefrom horizontally at both an uppermost and a lowermost portion thereof. Each sidewall has a notch formed adjacent a top edge and a bottom edge thereof. The notches in the sidewalls are complemental in size to the tabs of the dividers. Thus, the tabs of the dividers fit within the notches of the sidewalls.

A lid of planar rectangular shape fits over top edges of the sidewalls and the dividers to form a top surface of the container. When the lid is removed, four parallelopiped compartments are revealed. Each compartment has a portion of the platform on a bottom surface thereof and portions of two of the sidewalls and dividers for side surfaces thereof. A portion of the lid forms a top surface of each compartment.

Bags of fluid, especially fluids of high viscosity, are commonly stored within high-strength, flexible bags. A fluid filled bag of appropriate size is locatable within each of the compartments of the container. A liner of cardboard or a similar substance may be interposed between the fluid filled bag and sidewalls of each compartment to prevent snagging of the bag against sidewalls of the compartment. The fluid filled bag may also be enclosed within a vapor barrier, such as a plastic bag, to prevent spills from contaminating the container. Foam may be placed over the fluid filled bags and below the lid to provide the damping necessary to prevent the fluid from oscillating detrimentally within the container during shipping.

Straps are located horizontally around the container to secure the container before filling. Once filled, the lid is put in place over the container and vertical straps are located around the container. The container may then be easily handled by forklifts or other machinery and may be easily stacked on vehicles such a freight cars and vehicle trailers.

When the fluid within the bags is to be retrieved, the fluid may be pumped out of the bags or drained through access plugs while the bags remain within the container, or the bags may be hoisted out of the container and oriented to where the contents may be removed by slitting a lower portion of the bag and draining the contents therefrom. The container may be stored with only a portion of the compartments filled. If transport is required, the lid is replaced and a strap is fitted over the container and the lid. Once all of the fluid in each compartment has been removed, the sidewalls and dividers may be knocked down and then stacked upon the platform and the pallet for transport and reuse.

OBJECTS OF THE INVENTION

Accordingly, it is a primary object of the present invention to provide a collapsible palletized bin container having discrete regions therein.

Another primary object of the present invention is to provide a container which can handle fluids in discrete 55 gallon increments and yet be handled together in a manner commonly utilized for larger volumes.

Another object of the present invention is to provide a container which is collapsible and re-erectible to be reused, the container being collapsible to a substantially smaller volume than is occupied when the container is erected.

Another object of the present invention is to provide a collapsible palletized bin container having separate regions which are securely supported such that even when one region is filled and an adjacent region is empty, the regions do not deform.

Another further object of the present invention is to provide a collapsible palletized bin container which can expand somewhat when filled due to hydrostatic pressure of fluid therein and yet still maintain secure containment of the fluid.

Another further object of the present invention is to provide a compartmentalized, collapsible, palletized container which has a secure outer periphery which precludes infestation by pests therewithin.

Another further object of the present invention is to provide a container which is mountable upon a pallet for easy transportation thereof.

Another further object of the present invention is to provide a container for housing fluid within bags which allows the bags to be slid into and out of separate compartments of the container without rupturing the bags.

Another further object of the present invention is to provide a collapsible, palletized bin container which can house fluid within bags in a manner which precludes oscillation of the fluid during transportation, insuring safe transport thereof.

Another further object of the present invention is to provide a collapsible, palletized bin container having sidewalls rigid enough to support fluids on an interior thereof through the use of multi-layer cardboard or other materials as sidewalls thereof.

Viewed from a first vantage point it is an object of the present invention to provide a container, comprising, in combination a base, said base having an outer periphery, a plurality of walls extending up from said base about said periphery, said walls defining exterior confinement means, a plurality of dividers supported on said base and connected to said walls, said dividers defining interior confinement means, said interior and exterior confinement means collectively defining pigeon-hole-type regions above said base, and removeable connection means between said base and said walls to allow said container to be deployed from a stored compact state to an assembled state.

Viewed from a second vantage point it is an object of the present invention to provide a knock-down palletized container having a plurality of discrete compartments therewithin comprised of a base having a top surface and a bottom surface and including a pallet on said bottom surface, a plurality of exterior walls extending upward from and circumscribing said base, and a plurality of interior dividers extending between said exterior walls and dividing said container into said discrete compartments, said dividers and said exterior walls having complemental interconnection means preventing said interior walls from deflecting, preserving said compartments and strengthening said exterior walls.

Viewed from a third vantage point it is an object of the present invention to provide a method for assembling a collapsible container, the steps including orienting a pallet on a surface, fixedly attaching a support base on a top surface of the pallet, providing a pair of clips on opposed edges of the pallet such that portions of the clips extend upwardly from said pallet yet providing clearance between the clips and the base, placing a cruciform-shaped divider on a top surface of the base and extending upward from the base, providing the dividers with means for anchoring the dividers to sidewalls, placing two sidewalls adjacent the dividers and anchoring them thereto, orienting the two sidewalls thus assembled such that they are on sides of the pallet away from the clips, placing two other sidewalls on the pallet between the clips and the base, anchoring the dividers to the two other sidewalls, and strapping the sidewalls together.

Viewed from a fourth vantage point it is an object of the present invention to provide a method for disassembling a collapsible container, the steps including removing contents from within pigeon-hole-type regions of the container, detaching straps surrounding sidewalls of the container, removing two sidewalls having "L"-shaped brackets along edges thereof from a base and interior dividers of the container, removing remaining sidewalls from the base and dividers, and detaching the dividers from interconnection with each other and removing the dividers from the base.

Viewed from a fifth vantage point it is an object of the present invention to provide a material storage and transportation device, comprising, in combination a plurality of flexible bags receiving the material therein, and a container confining two or more said bags therewithin, the container including a base with a pallet thereunder, sidewalls defining an exterior of the container and a plurality of interior dividers defining at least two regions inside said container, said dividers separating said bags within said container, whereby material may be stored discretely in amounts less than that which would fill said entire container without modifying the size of said container.

Viewed from a sixth vantage point it is an object of the present invention to provide a container, comprising in combination a base, a pallet fixedly attached to and underlying said base, a plurality of walls circumscribing an outer periphery of said base and extending upwardly from said base, away from said pallet, a plurality of dividers, means anchoring said dividers to said upwardly extending walls, and a lid.

These and other objects will be made manifest when considering the following detailed specification when taken in conjunction with the appended drawing figures.

DESCRIPTION OF PREFERRED EMBODIMENTS

Figure 1:
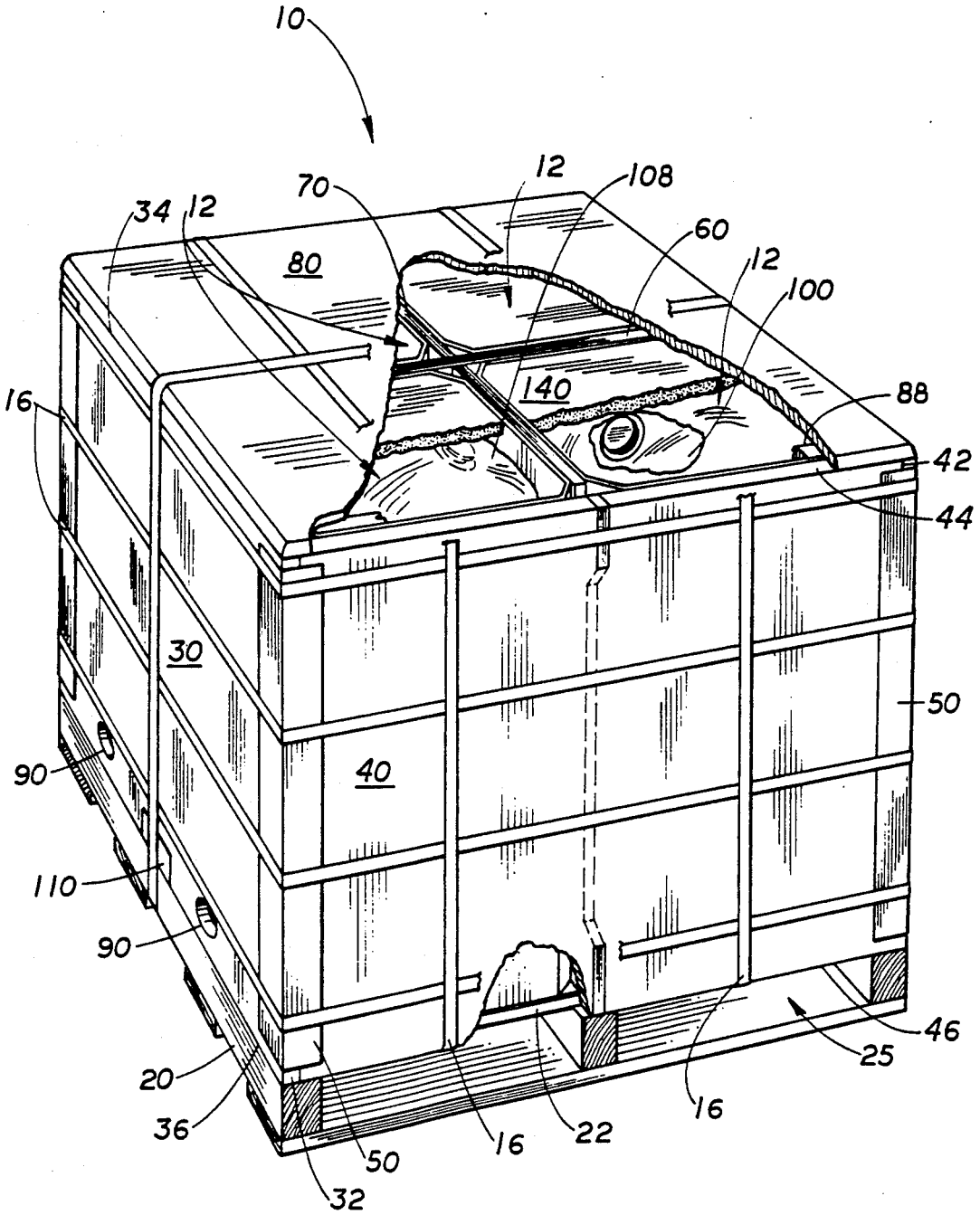
FIG. 1 is a perspective view of the container in its erected state with portions cut away to reveal interior details thereof.

Considering the drawings wherein like reference numerals denote like parts throughout, reference numeral 10 is directed to a compartmentalized, collapsible, palletized container. The container (10) rests upon a pallet (20). The container (10) includes long sidewalls (30), short sidewalls (40), a platform (22) and a lid (80). The container has a multiplicity of discrete regions forming compartments (12) on an interior thereof. The compartments (12) are defined by portions of the long sidewalls (30), short sidewalls (40), platform (22), and lid (80) as well as dividers (60), (70) which pass between sidewalls (30), (40) of the container (10). Separate parts of the container (10) are held securely together by straps (16) which are oriented both vertically and horizontally about the container (10).

Figure 2:
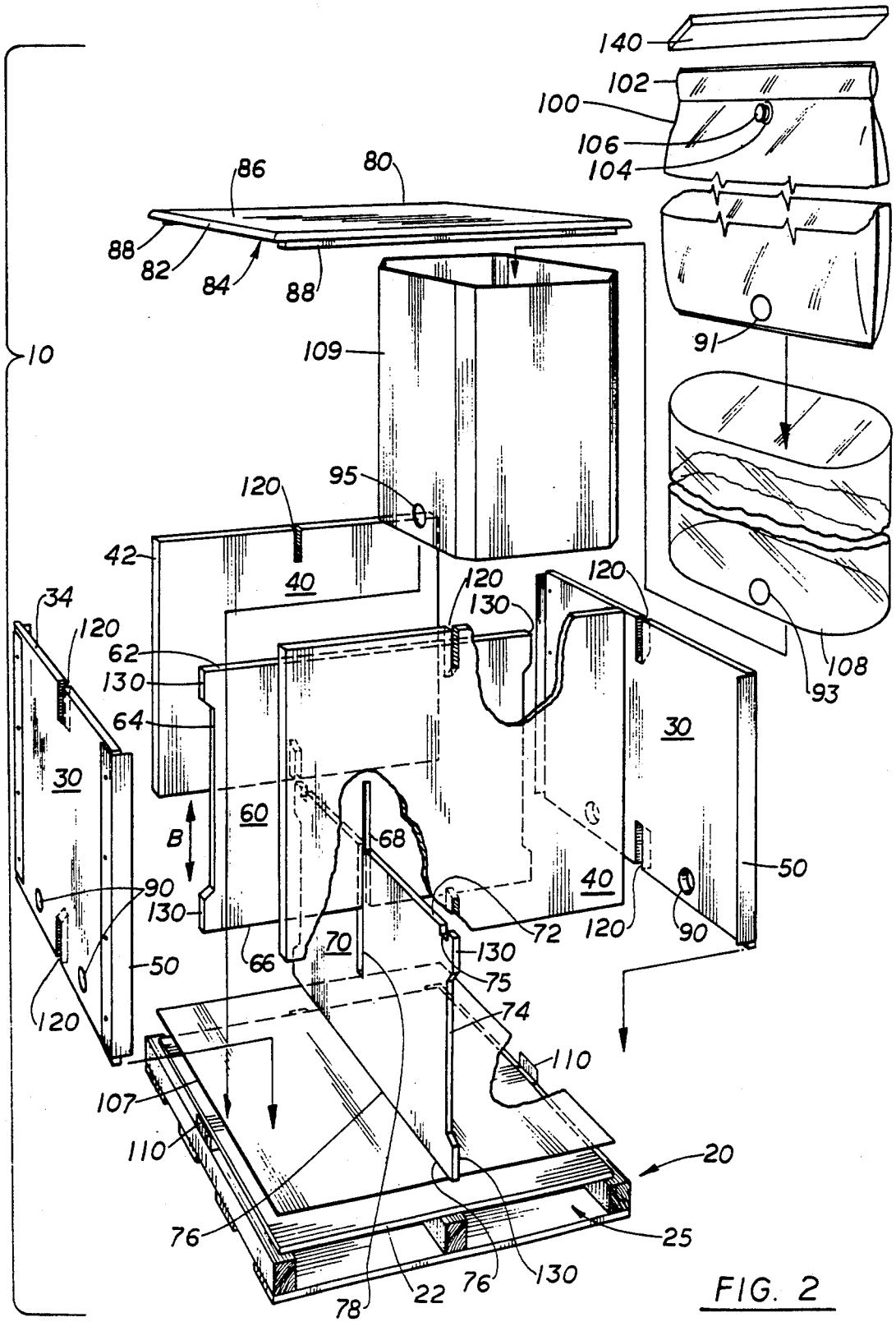
FIG. 2 is an exploded perspective view of the container which reveals the interrelationships of various portions of the container. Also, details are shown of the location of one of the fluid filled bags within a compartment of the container.

In essence, FIGS. 1 and 2 show that the container (10) is composed of a platform (22) forming a lower horizontal surface thereof, two long sidewalls (30) forming two opposite vertical sides thereof, two short sidewalls (40) forming two opposite vertical sides thereof, and a lid (80) forming an upper horizontal side thereof. Two dividers (60), (70) are oriented vertically between the lid (80) and the platform (22). The dividers (60), (70) divide the container (10) into four separate compartments (12). The platform (22) rests upon an upper surface of the pallet (20).

Two L-brackets (50) are riveted to each long sidewall (30) on sidewall edges (32) to prevent the short sidewalls (40) from displacing horizontally with respect to the long sidewalls (30). Two clips (110) attach to the pallet (20) on an upper surface thereof and along edges thereof adjacent to a bottom edge (36) of each long sidewall (30). The clips (110) have an upper plate (112) (FIG. 4) which holds the bottom edge (36) of each long sidewall (30) from displacing horizontally with respect to the pallet (20). Straps (16) are oriented horizontally around the container (10) to hold all of the sidewalls (30), (40) tightly together.

Each compartment (12) receives a fluid filled bag (100) therewithin. The bag (100) is preferably surrounded by a plastic liner (108) and then by a cardboard liner (109). Two access plugs (90) are located on lower portions of each long sidewall (30) to allow access to each compartment (12) through the long sidewalls (30), should the bag (100) be emptied by draining or pumping from the bag's bottom. Alternatively, the bags (100) can be emptied after removal through a hoist mechanism (150), shown in FIG. 6. With the bags (100) removed, the container (10) is collapsible (FIG. 5) for convenient transport and reuse.

More particularly, and in general reference to FIGS. 1 through 4, details of the structural configuration of the container (10) are revealed. The pallet (20) includes a series of base slats (24) (FIG. 4) which are flat horizontally oriented elongate constructs. Each base slat (24) is preferably oriented parallel to other base slats (24). A plurality of stringers (26) (FIG. 4) are connected upon the base slats (24) with nails (21) or some other attachment means. Each stringer (26) is a rigid elongate orthorhombic construct which is oriented substantially perpendicular to the orientation of the base slats (24) in a horizontal plane.

Preferably three stringers (26) are placed upon the base slats (24) with two stringers (26) oriented with outside surfaces (29) thereof coplanar with extremities of the base slats (24). A third stringer (26) is oriented upon a middle portion of each base slat (24). In this configuration, two slots (25) are formed between the three stringers (26) and above the base slats (24) within which forks of a forklift may be easily oriented for lifting of the container (10).

Figure 4:
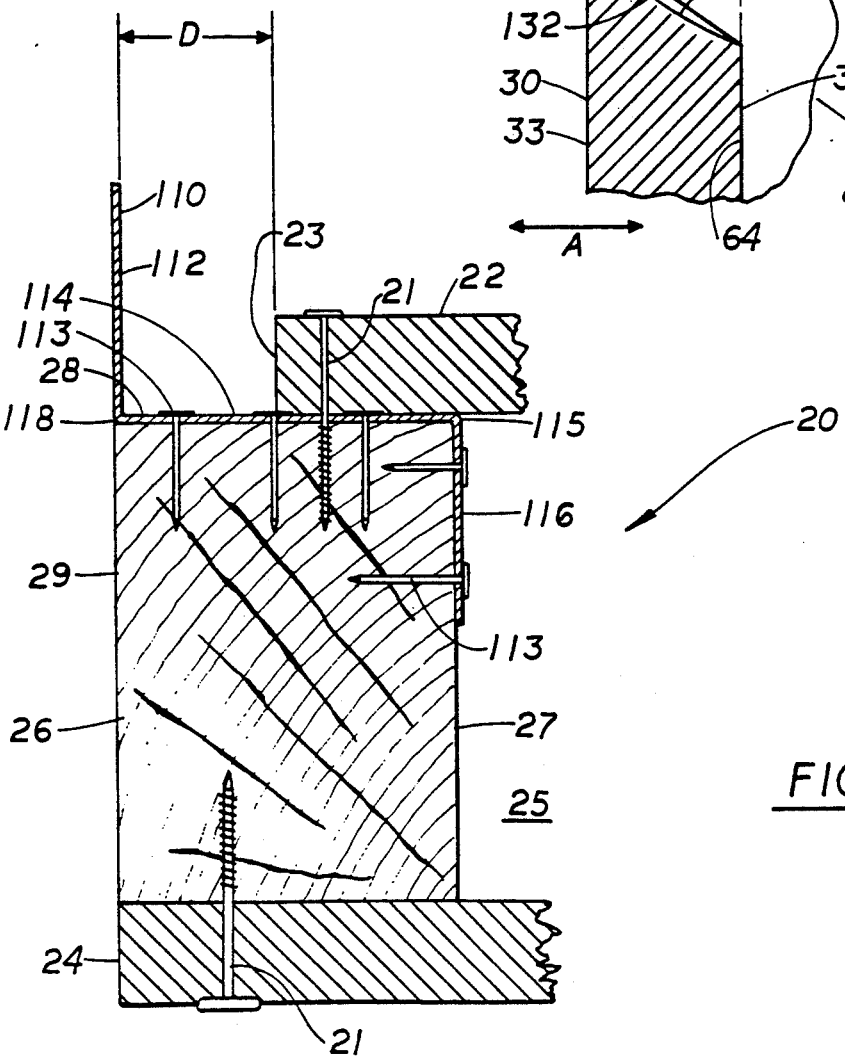
FIG. 4 is a cutaway of a portion of that which is shown in FIGS. 1 and 2 revealing details of the orientation of the clip and platform upon the stringers of the pallet.

Two clips (110), one of which is shown in detail in FIG. 4, are fixedly attached to the outside stringers (26). Each clip (110) has an upper plate (112) which extends vertically above a middle plate (114). An outside bend (118) forms a substantially 90 degree angle between the vertically oriented upper plate (112) and the horizontally oriented middle plate (114). A lower plate (116) extends vertically downward from an inside edge of the middle plate (114) at an inside bend (115). The inside bend (115) forms a substantially 90 degree angle between the middle plate (114) and the lower plate (116).

The clip (110) is attached to the outside stringers (26) substantially at a middle portion of a long axis of the stringer (26) with a fastening means such as nails (113). A variety of fastening means may actually be used. The clip (110) is fastened to the stringers (26) such that the lower plate (116) is adjacent to an inside surface (27) of each stringer (26). Also, the middle plate (114) of each clip (110) is oriented adjacent the top surface (28) of the stringer (26). Thus, the upper plate (112) projects upwardly with the outer surface (20) of stringer (26).

The platform (22) rests upon the top surfaces (28) of the stringers (26) and is attached thereto with nails (21) or some other attachment means. The platform (22) has horizontal dimensions which are slightly less than a footprint of the stringers (26) and the base slats (24). The platform (22) is fixedly attached to the stringers (26) to secure the pallet (20) to a lower portion of the container (10).

In assembling the pallets (20), the platform (22) is fastened precisely to the outside stringers (26) such that the platform (22) overlies a portion of the top surface (28) of the stringers (26) with enough surface contact to support the weight which is placed upon the platform (22). The stringers (26) are commonly milled from timber in a manner such that a width of the top surface (28) of the stringers (26) is not precisely uniform. Accordingly, the upper plate (112) of the clip (110) may be either coplanar with the outside surface (29) of the stringer (26), or it may be slightly inboard or outboard therefrom. In any case, a distance (D) between the upper plate (112) of the clip (110) and an edge (23) of the platform (22) remains constant.

The clip (110) is sized such that the distance (D) between the upper plate (112) and the platform (22) is equal to a thickness of the long sidewalls (30). Thus, the long sidewalls (30) are locatable tightly between the upper plate (112) of the clip (110) and the platform (22) without necessitating stringers (26) of precise dimensional accuracy. The platform (22), base slats (24) and stringers (26) are all preferably permanently fastened together in a non-removeable, noncollapsible manner. These parts thus form a base which can support other portions of the container (10) in either the erected or the collapsed form without modification.

Preferably, the container (10) has four sidewalls (30), (40) which form vertical sides of the container (10). The container includes two long sidewalls (30) and two short sidewalls (40). Each long sidewall (30) is a substantially planar rectangular construct. Each long sidewall (30) includes two side edges (32), a top edge (34) and a bottom edge (36). The bottom edge (36) resides between the upper plate (112) of the clip (110) and the edge (23) of the platform (22).

Each side edge (32) has an L-bracket (50) attached thereto. A plurality of rivet holes (54) (FIG. 5) are formed near each side edge (32) of each long sidewall (30) in locations which correspond with rivet holes (54) in the L-brackets (50). Rivets (38) (FIG. 5) are then connected through the rivet holes (52) attaching the L-bracket (50) to the long sidewall (30) along a side edge (32).

The L-brackets (50) are rigid elongate constructs which have two perpendicular plates. One plate (51) has a series of the rivet holes (52) thereon. The L-brackets (50) are of a length slightly less than a height of the long sidewalls (30) and short sidewalls (40). The L-brackets (50) are oriented such that the one plate (51) having the rivet holes (52) is adjacent an outside surface of each long sidewall (30) and an opposite plate (53) is adjacent to the side edge (32) and extends somewhat beyond the side edge (32).

With two L-brackets (50) on each long sidewall (30) and each long sidewall (30) located upon the pallet (20), the L-brackets (50) are oriented such that each opposite plate (53) from the L-bracket (50) extends toward the other long sidewall (30). The two short sidewalls (40) are substantially planar rectangular constructs which have a width equal to the distance between the two long sidewalls (30) when they are in place upon the pallet (20). The short sidewalls (40) have a height similar to the height of the long sidewalls (30). Each short sidewall (40) has two side edges (42) on opposite sides thereof which extend vertically, a top edge (44) oriented horizontally on an upper surface thereof and a bottom edge (46). The bottom edge (46) is horizontal and can rest upon the stringers (26) of the pallet (20) adjacent edges (23) of the platform (22).

The short sidewalls (40) are oriented in a vertical plane between the two long sidewalls (30). When the container (10) is in its erected form, side edges (42) abut against the L-brackets (50) and side edges (32) of the long sidewalls (30). The short sidewalls (40) and long sidewalls (30) thus form a periphery of the container (10) which confines the material contained therein from an exterior thereof when container (10) is in its erected form. Straps (16) are fastened horizontally about the sidewalls (30), (40) to tightly hold the sidewalls (30), (40) together.

While the preferred embodiment discloses a four-sided container (10), containers having fewer or more sides are also contemplated. The number of interior compartments (12) could also be modified.

The top divider (60) is a substantially planar rectangular construct having a length similar to a length of the short sidewalls (40) and a height similar to the height of the short sidewalls (40) and the long sidewalls (30). The top divider (60) is oriented vertically upon the platform (22) such that side edges (64) of the top divider (60) are adjacent an inside surface (31) (FIG. 3) of the long sidewalls (30). The top divider (60) rests upon the platform (22) with a bottom edge (66) thereof. The top divider (60) has a bottom slot (68) which extends vertically from the bottom edge (66) of the top divider (60) up to a location preferably substantially at a geometric center of the top divider (60). The slot (68) is of a width similar to a thickness of the bottom divider (70).

The bottom divider (70) is oriented upon the platform (22) in a vertical plane perpendicular to the top divider (60). The bottom divider (70) is a substantially planar rigid rectangular construct having a bottom edge (76) adjacent to the platform (22) and two side edges (74) which are locatable adjacent the short sidewalls (40) and a top edge (72) which is opposite the bottom edge (76). The bottom divider (70) is of a length similar to a length of the long sidewalls (40). The bottom divider (70) has a top slot (78) which extends from the top edge (72) of the bottom divider (70) down to a geometric center of the bottom divider (70). The top slot (78) is of a width substantially similar to a thickness of the top divider (60).

Accordingly, the bottom slot (68) of the top divider (60) can receive the thickness of the bottom divider (70) therewithin and the top slot (78) of the bottom divider (70) can receive the thickness of the top divider (60) therewithin. The top divider (60) and bottom divider (70) may be slid together perpendicularly, by relative motion therebetween along arrow B (FIG. 2) such that the top edge (62) of the top divider (60) and the top edge (72) of the bottom divider (70) are orientable in a single horizontal plane. Likewise, the bottom edge (66) and the bottom edge (76) are orientable in a single horizontal plane. The dividers (60), (70), when interconnected, define a cruciform shaped partition.

When the top divider (60) and the bottom divider (70) are oriented in place within the container (10) and adjacent the short sidewalls (40) and long sidewalls (30), they form a cruciform divider effectively dividing the container (10) into four distinct compartments (12). Thus, the dividers (60), (70) form an interior confinement means for the materials contained within each compartment (12).

Preferably, the top divider (60) and bottom divider (70) are removably attached to the long sidewalls (30) and short sidewalls (40), respectively, through the inclusion of tabs (130) integrally formed with the dividers (60), (70) at upper most and lower most portions of the side edges (64), (74) thereof. Notches (120) are formed at upper most and lower most portions of each sidewall (30), (40) adjacent the top edges (34), (44) and the bottom edges (36), (46) which are complemental to the tabs (130).

Figure 3:
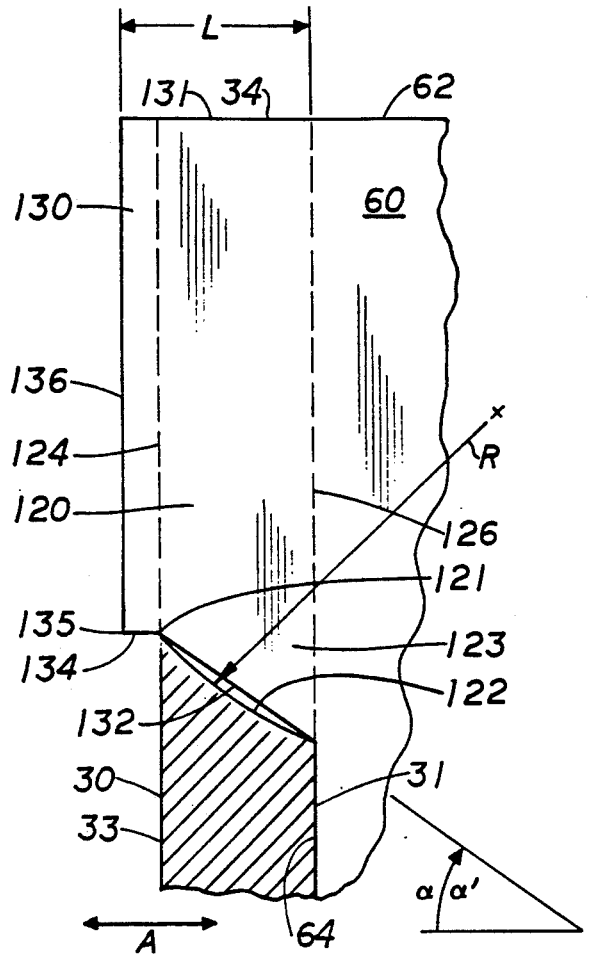
FIG. 3 is a detail of the tab and notch connection at the junction of each divider edge with the sidewalls of the container, shown also in FIG. 2.

FIG. 3 reveals details of the tab (130) and notch (120). The tab (130) and notch (120) together form an expansion joint between the sidewalls (30), (40), and the dividers (60), (70). The purpose of the expansion joint is to allow a tight fit between the divider (60), (70) and the sidewall (30), (40) even when these two parts bow or flex relative to each other. This feature is important when foodstuffs are being shipped because it prevents entry by insects at this point. Also, the tabs (130) and notches (120) are designed to be somewhat self-aligning. While FIG. 3 shows the specific appearance of a tab (130) along the top edge (62) of the top divider (60), these features are identical to features of the tabs (130) on the bottom divider (70) and are a mirror image of the features of the tabs (130) of the top divider (60) and bottom divider (70) which are adjacent the bottom edges (66), (76). Accordingly, only details of the tab (130) attached to an upper portion of the side edge (64) of the top divider (60) and details of the correlating notch (120) in the long sidewall (30) are shown and described.

The tab (130) extends outward beyond the side edge (64) of the divider (60) a distance slightly greater than a thickness of the notch (120) formed in the sidewall (30). The tab (130) has a horizontal upper surface (131), which extends parallel to the top edge (62) of the divider (60). An outside edge (136) of the tab (130) is oriented vertically and extends from the upper surface (131) down a distance equal to a vertical external height of each notch (120) formed in the sidewall (30). The outside edge (136) defines an external height of the tab (130).

The tab (130) extends horizontally from a lowermost end (135) of the outside edge (136) back toward the side edge (64) forming an overhang (134). The overhang (134) stops at a point a distance away from the side edge (64) equal to a thickness of the long sidewall (30). The tab (130) then angles (at an angle $\alpha'$) slightly downward along a slope (132) which connects the overhang (134) back to the side edge (64) of the top divider (60). The outside edge (136) plus the height of the slope (132) defines an internal height of the tab (130).

Likewise, the notch (120) has a contour which conforms to an outline of the tab (130) from the side edge (64) to the beginning of the overhang (134). In other words, the notch (120) frictionally engages the tab (130). The notch (120) has a thickness similar to a thickness of the sidewall (30). This thickness is less than a length (L) of the tab (130). Thus, a slope (122) on a lowermost portion (123) of the notch (120) extends at a constant angle ((x) from the inside surface (31) of the long sidewall (30) to an outside surface (33) thereof. The slope (122) of the notch (120) is at an angle ($\alpha$) similar to the angle ($\alpha'$) of the slope (132) of the tab (130).

The angles ($\alpha$, $\alpha'$) may be any of a variety of mating angles but preferably each are approximately 30°. In milling the sidewall (30), a circular cutting tool is often used to create the notch (120). This results in the slope (122) having a slight radius of curvature (R) causing an uppermost edge (121) of the slope (122) to be more pointed than otherwise. This feature assists in tightly mating the notch (120) to the tab (130). In this way, slope (122) and slope (132) present surfaces in tangential registry even in the event of deflection of the sidewall (30) relative to the divider (60). These slopes (122), (132) also allow the tab (130) to be easily aligned within the notch (120) without precise vertical alignment thereof.

The overhang (134) extends a distance away from the long sidewall (30), along arrow A, equal to an anticipated maximum expansion of the long sidewall (30) when hydrostatic pressure is exerted from within the container (10) by fluid contained within the bags (100). The overhang (134) would then remain in constant contact with the uppermost edge (121) of the slope (122) as a safety stop at maximum expansion. Thus, the tab (130) and notch (120) maintain a tight seal precluding the migration of ants or other pests into the container (10) all along the length of sliding contact.

The lid (80) is a substantially planar rigid rectangular construct which has dimensions which allow the lid (80) to overlie each of the top edges (34), (44), (62), (72). Vertical straps (16) are fastened over the lid (80) and around the container (10). The lid (80) has peripheral edges (82) which are radiused to curve downward slightly, to prevent the straps (16) from either damaging the peripheral edges (82) of the lid (80) or from weakening the strap (16) because of a sharp bend at the change in direction. The lid (80) is defined by a top side (86) opposite from a lower side (84). Two ribs (88) are fixedly attached to the lower side (84) of the lid (80). Each rib (88) is preferably a tetragonal elongate construct having a length similar to a width of the two short sidewalls (40). Each rib (88) is spaced a distance somewhat away from the peripheral edges (82) of the lid (80). These ribs (88) prevent gross motion of the lid (80) relative to the sidewalls (30), (40).

Two rib notches (75) are located within top edges (72) of the bottom divider (70). Each rib notch (75) has a cross section similar to a cross section of the ribs (88). The rib notches (75) are located a distance away from side edges (74) of the bottom divider (70) such that they align with the ribs (88) when the lid (80) is centered in place on top of the sidewalls (30), (40). The ribs (88) and rib notches (75) prevent the lid (80) from shifting laterally.

Two access plugs (90) may be located in each long sidewall (30) of the container (10) such that they are centrally located on lower most portions of each compartment (12) of the container (10). Because each long sidewall (30) has two access plugs (90) thereon, an access plug (90) is provided for each of the four compartments (12). The access plugs (90) may communicate with the bags (100) within the compartments (12) to allow fluid within the bags (100) to be drained through the access plugs (90). Preferably, the access plugs (90) are located as low as possible on the long sidewalls (30) to allow fluid to drain through the access plugs (90) without the necessity of a pump.

Figure 6:
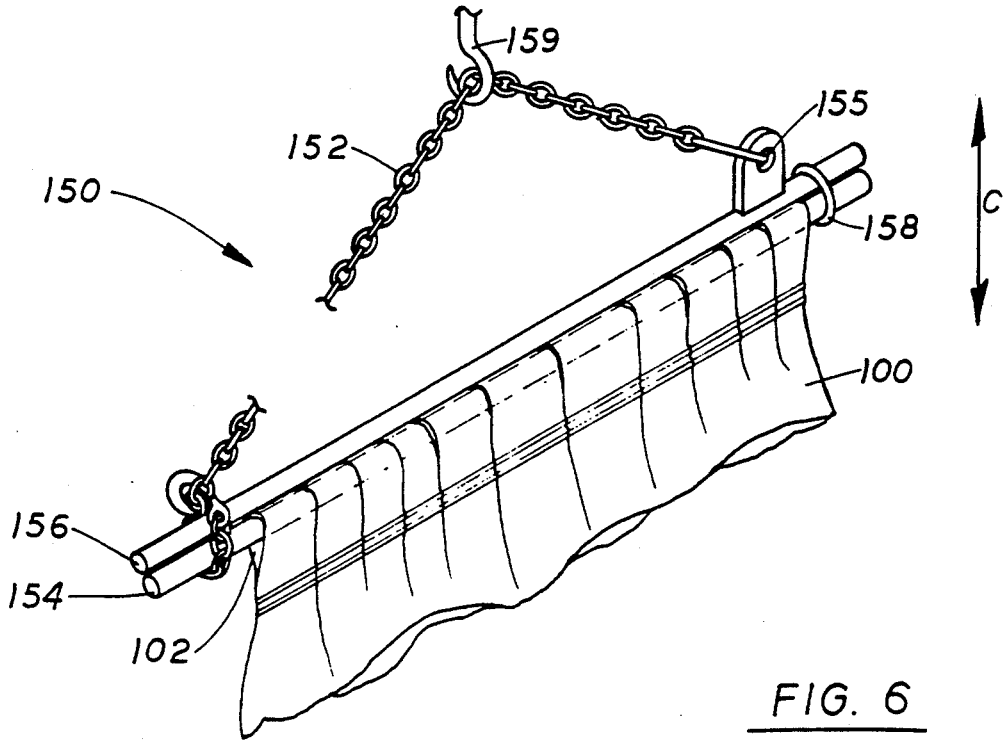
FIG. 6 is a perspective view revealing the bag connected to a hoist structure which is utilized to remove the bag out of a compartment of the container.

Reference is now made to FIGS. 2 and 6 which reveal details of the bag (100) and the compartments (12). Each compartment (12) is preferably a parallelopiped volume defined on one side by a portion of one long sidewall (30), on a second side by a portion of one short sidewall (40), on a third side by a portion of the top divider (60) and a fourth side by a portion of the bottom divider (70). A top of each compartment (12) is defined by a portion of the lower side (84) of the lid (80) and a bottom side of the compartments (12) is defined by the platform (22).

A single flat cardboard liner (107) is preferably located on the platform (22) prior to placement of the dividers (60), (70). The cardboard (107) provides a lining on a bottom surface of each compartment (12). Additionally, a vertically extending cardboard liner (109) is also placed within each pigeonhole defining each compartment (12). The vertical liner (109) is located adjacent to each of the sidewalls (30), (40), and dividers (60), (70), extending from the platform (22) up to the lid (80) in a somewhat cylindrical fashion within the compartment (12). Preferably four pieces of cardboard (109) are used with a single piece of cardboard (109) surrounding sides of each compartment (12).

A plastic liner (108) which is impermeable to vapor is preferably located inboard from the cardboard liners (107), (109). The bag (100) is located inside the plastic liner (108). A variety of liners which prohibit vapor migration may be substituted for the plastic liner (108). Finally, foam (140) (FIG. 1) may be placed above the bag (100) but below the lid (80). The foam (140) provides damping for the fluid within the container (10) to prevent the fluid from harmonic vibration which can occur in transit which would otherwise destroy the container (10) or rupture the bag (100). Solid objects may also be stored within the compartments (12).

In loading the container (10), the bag (100) can be filled with fluid before the bag (100) is placed within the plastic liner (108) within each compartment (12). If the fluid is highly viscous, a shaping funnel (not shown) may be used to slide the bag (100) into one of the rectangularly cross-sectioned compartments (12). Alternatively, the fluid may be pumped into the bag (100) with the bag (100) already in place within a compartment (12) of the container (10).

As shown in detail in FIG. 6, the preferable mode of removal of fluid from the bag (100) is through utilization of a loop (102) forming an upper end of the bag (100). An inner bar (154) is located through the loop (102). An outer bar (156) is then oriented parallel to the inner bar (154), but outside of the loop (102). The two bars (154), (156) are then lashed together using either a chain (152), a ring (158) or some other type of connecting mechanism. An eyelet (155) is attached to the outer bar (156) which communicates with the chain (152). The chain (152) can be grasped by a hook (159) which can then lift the two bars (154), (156) upwards. A variety of different connecting means may be substituted for the bar and chain assembly shown.

Upward motion of the bars (154), (156), along arrow C, pulls the bag (100) out of the compartment (12). The cardboard (109) and plastic liners (108) facilitate extraction. The bag (100) then may be located in a region where the contents are to be emptied. The bag (100) may be cut on a lower surface thereof (not shown) and the contents of the bag (100) drained therefrom. Because of the container (10) construction, removal of one bag (100) will not cause distortion of the empty pigeon hole by the other filled pigeon hole compartments (12).

Alternatively, fluid within the bag (100) may be removed by either draining the bag (100) through the access plug (90) and a drain hole (91), plastic liner hole (93) and cardboard liner hole (95) communicating with the access plug (90) while the bag (100) is within the container (10). Fluid may also be removed by pumping the fluid out of the bag (100) through an upper filler (104) which is enclosed by filler cap (106) (FIG. 1) located at a top of the bag (100).

If bags (100), filling only a portion of the container (10), are to be stored, the lid (80) is replaced on the container (10). Preferably, at least one vertical strap (16) is then located around the container (10).

Figure 5:
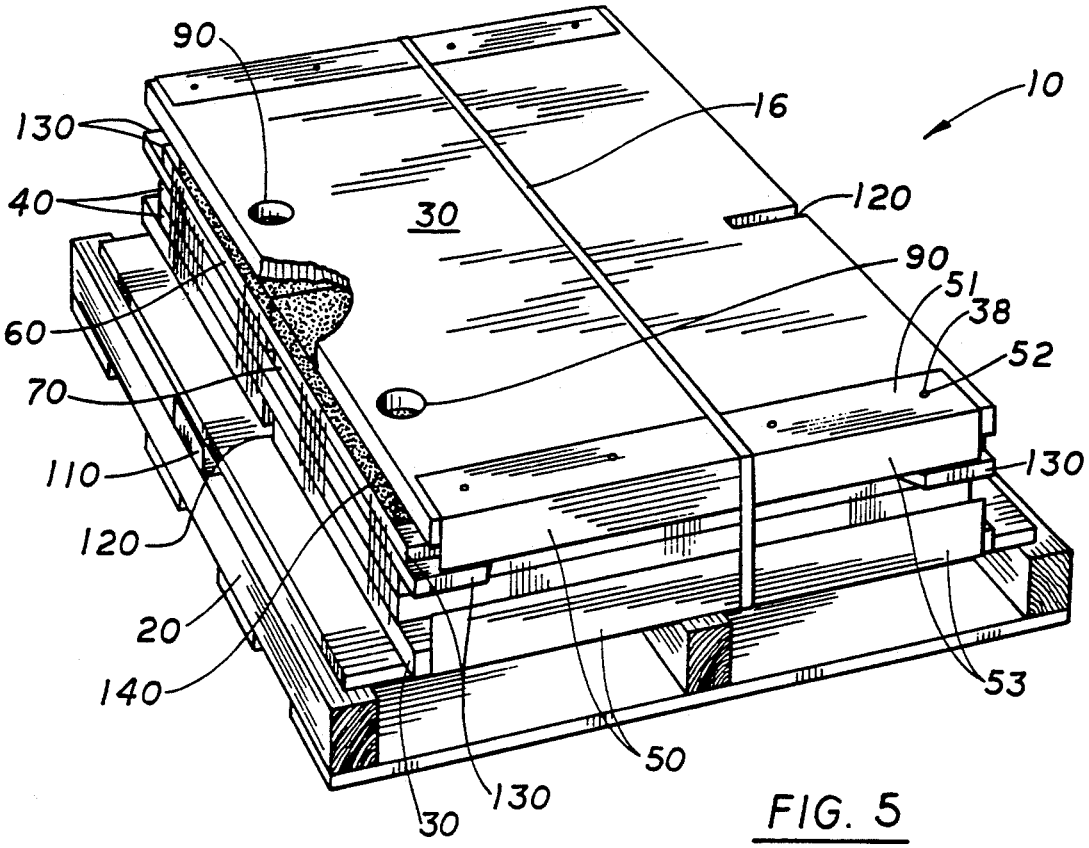
FIG. 5 is a perspective view of the container in its collapsed mode.

Referring now in detail to FIG. 5, details of the collapsibility of the container (10) are shown. The container (10) is designed to be collapsed into a reduced volume form for shipping when empty. The pallet (20) is preferably collapsed so that a forklift can move stacks of collapsed containers (10). The long sidewalls (30) and short sidewalls (40) are detachable from each other and the top divider (60) and bottom divider (70) are detachable from the long sidewalls (30) and the short sidewalls (40) such that they are all stackable in adjacent horizontal planes resting upon each other.

Preferably, one long sidewall (30) is first located adjacent the platform (22) of the pallet (20) with the opposite plates (53) of the L-brackets (50) extending upwards. Next, the two short sidewalls (40) are stacked upon the first long sidewall (30). Next, the two dividers (60), (70) are stacked upon the two short sidewalls (40). The foam (140) is optionally placed above the dividers (60), (70). Finally, the other long sidewall (30) is placed upon the stack with the opposite plates (53) of the L-brackets (50) extending downwards.

This entire bundle may be strapped with straps (16) to prevent the separate parts from moving with respect to each other. Preferably, the lid (80) is not packed with the other parts upon the pallet (20) as shown in FIG. 5. Rather, a plurality of lids (80) from various separate containers (10) may be placed upon a separate pallet (not shown). Thus, while the containers (10) are being re-erected to be refilled with fluid filled bags (100), all of the parts for the container (10) are contained in single discrete packages, except for the lids (80). The reason for segregating the lids (80) away from the rest of the container (10) is that when the containers (10) are to be reused, the lid (80) will be the last item needed in the assembly line.

The containers (10) may then be erected in a form as substantially shown in FIG. 1, except for without the lid (80) and vertically oriented straps (16). Fluid filled bags (100) may be located within the compartments (12) along with cardboard liners (109) and plastic liners (108). Finally, the lids (80) may be located upon the filled containers (10) at a separate part of a filling assembly line from where the other portions of the container (10) are erected upon the pallet (20).

Figure 7:
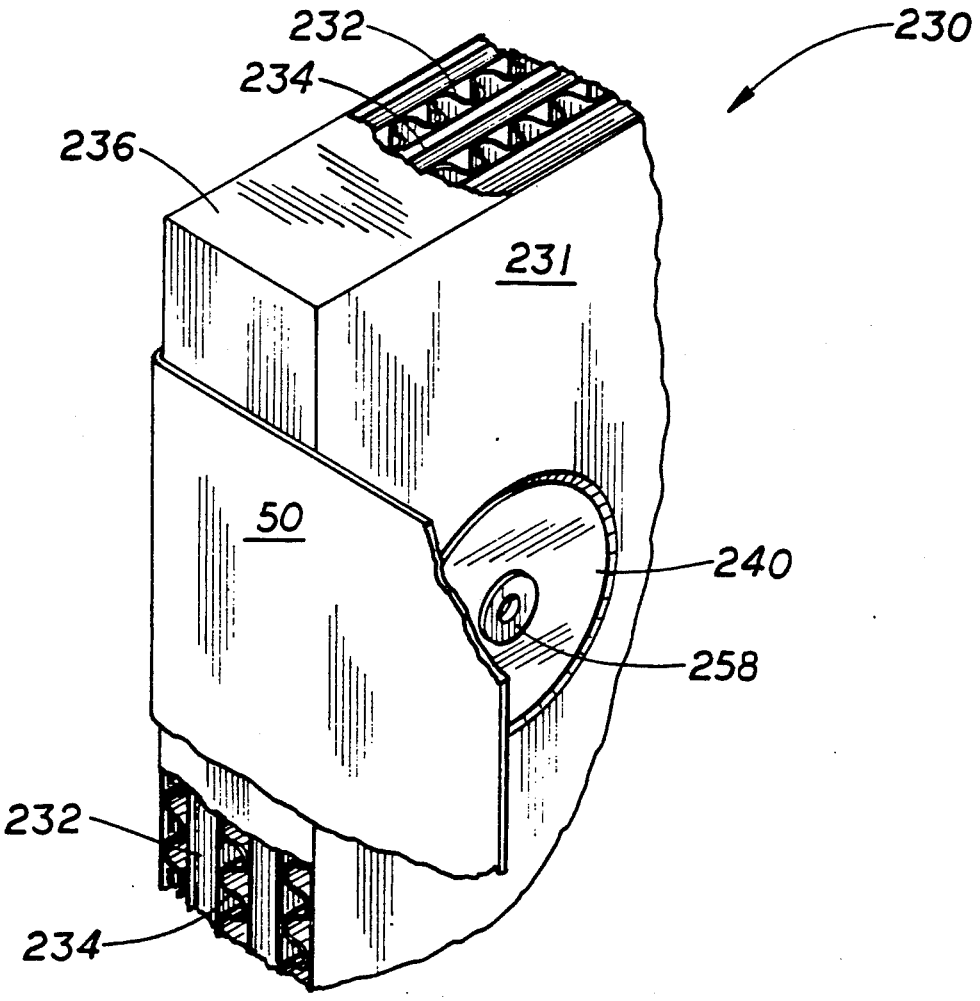
FIG. 7 is a detail of an alternative embodiment of that which is shown in FIGS. 1, 2, and 5 revealing an alternative way of mounting the L-brackets onto the long sidewalls and an alternative material utilizable to form the long and short container sidewalls.

Preferably, the lid (80), long sidewalls (30), short sidewalls (40), and dividers (60), (70) are formed from plywood. Alternatively, these parts may be constructed from a sufficiently rigid cardboard laminate structure. FIG. 7 reveals details of a type of cardboard laminate structure which can be utilized in place of various walls within the container (10).

As one example, a cardboard sidewall (230), shown in FIG. 7, may have the L-bracket (50) attached thereto with rivets (258) which communicate with washers (240). The washer (240) protects the cardboard side surface (231) from collapsing. Furthermore, the washer (240) prevents the rivet (258) from tearing out of its location within the cardboard sidewall (230). A fragmented view shows the cardboard sidewall (230) revealing alternating corrugations defining vertical layers (232) and horizontal layers (234) which are enclosed by an end layer (236). The alternating layers (232), (234) allow the cardboard sidewall (230) to exhibit strength in both vertical and horizontal directions.

In use and operation, and referring primarily to FIG. 2, the container (10) may be erected from separate constructed parts in the following manner. First, the pallet (20) and attached platform (22) are located on a horizontal surface. Next, a horizontal flat layer of cardboard (107) is placed upon the platform (22). The top divider (60) and bottom divider (70) are next connected, by relative motion, along arrow B, such that their slots (68), (78) communicate together with the two dividers (60), (70) forming an "X" pattern. The two dividers (60), (70) are then oriented appropriately on the platform (22) (see FIG. 2).

Next, the two short sidewalls (40) are located adjacent the side edges (74) of the bottom divider (70) with tabs (130) of the bottom divider (70) residing within notches (120) formed in the short sidewalls (40). The long sidewalls (30) are then located with bottom edges (36) thereof between the clips (110) and the platform (22) and with notches (120) of the long sidewalls (30) receiving tabs (130) of the top divider (60) therewithin. Each of the tabs (130) in the top divider (60) and the bottom divider (70) are thus located within notches (120) within the long sidewalls (30) and short sidewalls (40). The L-brackets (50) thus reside at corners of the container (10), holding the sidewalls (30), (40) together and protecting corners of the container. Straps (16) are then oriented horizontally around a periphery of the sidewalls (30), (40). Preferably, three straps (16) are utilized. Optionally, a fourth top strap (16) may be utilized.

Next, one of the cardboard liners (109) is located within each compartment (12). One of the plastic liners (108) is then located within each cardboard liner (109). At this point, the filled bag (100) may be located within the plastic liner (108). Foam layers may then be added within each compartment (12) on top of each bag (100) and the lid (80) located on top of the container (10). Finally, straps (16) are locatable vertically around the container (10) to prevent the lid (80) from moving relative to the container (10) and to hold the various parts of the container (10) tightly in place. The container (10) is now filled and is able to be stored and transported as a single unit. A reversal of the above steps will result in collapsing of the container (10).

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A container, comprising, in combination:

a base, said base having an outer periphery, a means for confining contents of said container from an exterior of said container, said exterior confinement means including a plurality of walls extending up from said base about said periphery, a means for confining contents of said container from portions of an interior of said container, said interior confinement means including a plurality of dividers supported on said base and connected to said walls, said interior and exterior confinement means collectively defining compartments above said base, and removable connection means between said base and said walls to allow said container to be deployed from a stored compact state to an assembled state; and wherein said exterior confinement means and said interior confinement means are connected through a removeable connection means, whereby said container may be collapsed to a smaller volume when said container is empty and re-erected when said container is to be utilized; and wherein said removeable connection means between said interior confinement means and said exterior confinement means includes a plurality of horizontal expansion joints;

whereby attachment of said walls of said exterior confinement means to said dividers of said interior confinement means is preserved when said walls expand slightly horizontally away from said dividers due to substances being placed within said compartments; and wherein each of said expansion joints includes a notch in one said wall and a tab extending from an edge of one said divider adjacent said wall, said tab having a height which decreases from said edge of said divider to an outside edge of said tab.

2. The container of claim 1 wherein said base includes a pallet thereunder supporting said base.

3. The container of claim 1 wherein said base includes a platform of flat horizontal construction with side edges supported upon and fastened to a plurality of stringers, and wherein a clip having a vertical upper plate is connected to said base in an orientation locating said upper plate of said clip in an orientation parallel to said side edges of said platform and spaced from said side edges a distance equal to a width of said walls;

and wherein lower edges of said walls are located between said upper plate of said clip and said side edges of said platform, holding said walls adjacent said platform upon said base.

4. The container of claim 1 wherein said walls of said container are separate from all other portions of said container.

5. The container of claim 4 wherein said tabs exhibit a lesser height at said outside edges thereof than at any other portion of said tabs.

6. The container of claim 5 wherein each said horizontal expansion joint includes a notch in one of said walls of said exterior confinement means and a tab supported upon an edge of one of said dividers of said said interior confinement means adjacent one of said walls of said exterior confinement means;

each said expansion joint including said notch having a width substantially similar to a thickness of said tab, and an external height of said notch similar to an external height of said tab, said external height of said notch less than said internal height of said notch;

said tab of each said expression joint maintaining a constant height from an outside edge of said tab in toward said edge supporting said tab for a distance selected from a group of distances including a distance greater than an amount of expansion of said exterior confinement means and a distance equal to an amount of expansion of said exterior confinement means; and wherein said tab includes a horizontal overhang and a slope on a bottom surface thereof, said horizontal overhang defining a constant height portion of said tab and said slope defining a changing height portion of said tab, said horizontal overhang adjacent said outside edge of said tab; and wherein said external height of said notch is defined on a lower surface by an uppermost edge, said uppermost edge remaining adjacent said horizontal overhang during expansion of said exterior confinement means;

whereby each said tab can easily fit into one of said notches of said expansion joint and side therewithin while maintaining a tight fit on an exterior of one of said notches, thereby preventing insect migration into said interior of said container.

7. A knock-down palletized container having a plurality of discrete compartments therewithin, comprising, in combination:

a base having a top surface and a bottom surface and including a pallet on said bottom surface, a plurality of exterior walls extending upward from and circumscribing said base, and a plurality of interior dividers extending between said exterior walls and dividing said container into said discrete compartments, said dividers and said exterior walls having a plurality of complemental interconnection means for preventing said interior dividers and said exterior walls from deflecting at an intersection of said dividers and said walls, preserving said compartments and strengthening said exterior wall, said interconnection means located at an uppermost corner and a lowermost corner of side edges of each said divider.

8. The container of claim 7 wherein said exterior walls include two first exterior walls and two second exterior walls, said first exterior walls having edges with means for restraining said second exterior walls adjacent edges of said first exterior walls, whereby said first exterior walls and said second exterior walls connect together to define an exterior of said container; and wherein each said complemental interconnection means includes two notches formed in upper and lower edges of one said exterior wall and two tabs extending from upper and lower corners of an edge of one said interior divider in an orientation allowing each said tab to be located within one adjacent said notch of one of said complemental interconnection means, said notch and said tab of each said complemental interconnection means sized similarly for mutual interconnection and resistance of horizontal motion parallel to said exterior wall by an adjacent said divider.

9. The container of claim 8 wherein said two first exterior walls are each oriented in spaced, parallel configuration, said two second exterior walls are each oriented in spaced, parallel configuration and said interior dividers are of a length similar to a distance between two of said exterior walls, and said interior dividers include a plurality of said tabs on each edge thereof, whereby said tabs connect each side of said interior dividers to said exterior walls.

10. The container of claim 9 wherein said tabs extend away from said edges of said interior walls a distance greater than a thickness of said exterior walls such that said tabs have sufficient length to be retained in said notches, whereby bowing of said exterior walls outward will not dislocate said tabs from said notches.

11. The container of claim 9 wherein said tabs having a sloping sidewall and said notches have a sloping sidewall, such that said tabs have an exterior height which is less than an interior height thereof and said notches are selected from a group of notches including notches with an exterior height equal to an interior height thereof and notches with an exterior height less than an interior height thereof, whereby said tabs easily fit into said notches while providing a tight seal therebetween.

12. The container of claim 8 wherein two said interior walls are included in said container, a first said interior wall extending between said two first exterior walls and a second interior wall extending between said two second walls, said two interior walls intersecting each other within said exterior walls through a top slot in a top edge of one of said interior walls and a bottom slot in a bottom edge of the other of said interior walls, said top slot and said bottom slot of a thickness similar to a thickness of said interior walls and of lengths such that a sum of the lengths of said top slot and said bottom slot is selected from a group of slots greater than a height of a shorter of said interior walls and slots equal to a height of a shorter of said interior walls, and wherein a lip is provided sized to overlie said first exterior walls and said second exterior walls, said lid having a lower surface with two tetragonal ribs extending along two opposite parallel edges of said lid;

wherein one of said second interior walls includes two rib notches on a top edge thereof, each said rib notch oriented such that when said lid is upon said container said ribs reside within said rib notches; and wherein said tabs include an upper surface parallel to and extending from a top edge of the divider a distance greater than a thickness of the sidewalls, an outside edge extending downward perpendicular to said upper surface, said outside edge being adjacent said upper surface, an overhang defining a surface parallel to said upper surface and spaced from said upper surface a distance equal to a height of said outside edge, said overhang being adjacent said outside edge, and a slope defining a surface oblique with respect to said overhang and said outside edge, said slope extending from a location adjacent said overhang to a location adjacent the side edge of the divider, said slope closer to said upper surface at said location adjacent said overhang than at said location adjacent the side edge of the divider.

13. The container of claim 8 wherein a means to center the sidewalls vertically with the dividers is provided, said centering means including said tabs on each said edge of each said divider including a slope thereon sloping toward a center of the container and said notches on each said edge of each said sidewall including a slope thereon sloping toward said center of said container, such that when each said sidewall impacts said edge of an adjacent said divider, said slopes of said tabs and said slopes of said notches contact each other and encourage said notches of said sidewall to be centered around said tabs of said divider.

14. A method for assembling a collapsible container, the steps including:

orienting a pallet on a surface;

fixedly attaching a support base on a top surface of the pallet, providing a pair of clips on opposed edges of the pallet such that portions of the clips extend upwardly from said pallet yet providing clearance between the clips and the base, placing a plurality of dividers on a top surface of the base and extending upward from the base, the dividers combined to exhibit a cruciform-shape, providing the dividers with means for anchoring the dividers to sidewalls, placing two sidewalls adjacent the dividers and anchoring them thereto by orienting the sidewalls in a vertical plane perpendicular to one of the dividers at a height approximately equal to a height of the dividers upon the base and translating the sidewalls toward the dividers until notches within the sidewalls receive tabs extending from the dividers, the notches disposed at uppermost and lowermost edges of the sidewalls and the tabs disposed at uppermost and lowermost corners of the dividers, the notches and the dividers sloped complementally on bottom surfaces thereof toward a geometric center of the container, and allowing the tabs to slide vertically along the slopes of the notches to align the sidewalls precisely with the dividers, orienting the two sidewalls thus assembled such that they are on sides of the pallet away from the clips, placing two other sidewalls on the pallet between the clips and the base, anchoring the dividers to the two other sidewalls, and employing straps to secure the sidewalls together.

15. The method of claim 14 including segregating compartments of the thus formed container from one another, the steps including:

placing a liner between the cruciform-shaped dividers and the base prior to placement of the dividers thereon, placing annular liners within each compartment, placing an open ended bag of impervious material within each compartment with an open end of the bag facing away from the base, inserting the contents to be transported within the bag, placing a lid on the container, and configuring the tabs of the dividers to have a length greater than a thickness of the notches of the sidewalls, the tabs having a horizontal overhang extending from the slope thereof to an outside edge thereof, the overhang maintaining contact with the bottom surface of the notch even if the sidewall having the notch therein is displaced horizontally away from a center of the container.

16. The method of claim 15 including interposing a means for damping oscillation of the contents between the lid and the bag.

17. The method of claim 14 including the step of disassembling the container through the steps of:

removing contents from within the compartments of the container, detaching the straps surrounding the sidewalls of the container, removing the two sidewalls having L-shaped brackets along edges thereof from the base and interior dividers of the container, removing the remaining sidewalls from the base and dividers by displacing the sidewalls initially only horizontally away from the adjacent dividers, and detaching the dividers from interconnection with each other and removing the dividers from the base.

18. The method of claim 17 further including:

stacking parts of a collapsed container, the steps comprising:

placing a first sidewall having "L"-brackets along edges thereof flat upon a pallet with its L-brackets extending upward, placing sidewalls of the container without L-brackets and interior dividers of the container flat upon the sidewall already upon the pallet, placing a second sidewall having L-brackets along edges thereof flat upon the sidewalls and dividers with its "L"-brackets extending downward, and placing a strap around the container parts and the pallet, whereby a sandwich of sidewalls and dividers are oriented upon a pallet for convenient storage and transport.

19. A material storage and transportation device, comprising, in combination:

a plurality of flexible bags receiving material therein, and a container confining said bags therewithin, the container including a base with a pallet thereunder, sidewalls defining an exterior of the container and a plurality of interior dividers defining at least two regions inside said container, said dividers separating said bags within said container, whereby material may be stored discretely in amounts less than that which would fill said entire container without modifying the size of said container; and wherein said container includes connection means between said sidewalls and said base and between said sidewalls and said interior dividers, whereby said container is collapsible into substantially flat separate pieces and reassembleable, whereby storage of said container while empty requires less space; and wherein said connection means includes a horizontal width expansion joint, such that when said sidewalls bulge outwardly due to forces imposed thereon, said connection means maintains connection between said sidewalls and said dividers.

20. The device of claim 19 wherein said plurality of internal dividers includes two dividers oriented orthogonally to each other within said container defining four regions therein, said dividers interlocking at an intersection thereof;

and wherein said sidewalls include four sidewalls which define a periphery of said container, each said sidewall being orthogonal to and attached to one of said two dividers and parallel to and spaced from the other of said two dividers;

and wherein said container has an orthorhombic exterior shape which allows for stacking of said containers both vertically and horizontally adjacent each other; and wherein said horizontal width expansion joint includes a notch in one said wall and a tab extending from an edge of one said divider adjacent said wall, said tab having a height which decreases from said edge of said divider to an outside edge of said tab.

21. The device of claim 19 wherein said sidewalls include access plugs near lower edges thereof, said access plugs extending through said sidewalls, whereby access is provided to the material contained therein.

22. The device of claim 19 wherein said container includes a lid enclosing upper portions of each discrete region.

23. The device of claim 22 wherein damping means is provided within said container to dampen oscillation of materials within said container.

24. A container, comprising in combination:

a base, a pallet fixedly attached to and underlying said base, a plurality of walls circumscribing an outer periphery of said base and extending upwardly from said base, away from said pallet, a plurality of dividers, means anchoring said dividers to said upwardly extending walls, and a lid; and wherein said means anchoring said dividers to said upwardly extending walls includes means for expanding to allow said walls to flex away from said dividers yet remain connected to said dividers; and wherein said expansion means includes a notch in one said wall and a tab extending from an edge of one said divider adjacent said wall, said tab having a height which decreases from said edge of said divider to an outside edge of said tab.

25. The container of claim 24 wherein said expansion means includes a plurality of tabs on edges of said dividers and notches formed complementally with said tabs within said walls, said tabs and said notches having a trapezoidal appearance with a sloping surface on one side of each said tab and each said notch such that said sidewalls having said notches can easily slide horizontally away from adjacent said dividers, but said dividers having said tabs are restricted from sliding horizontally parallel to adjacent said sidewalls; and wherein each said sidewall is a discrete piece from other portions of said container; and wherein said tabs exhibit a lesser height at said outside edges than any other portion of said tabs; and wherein said dividers include two tabs on each side edge thereof, a first tab at an uppermost corner of each said side edge and a second tab at a lowermost corner of each said side edge.

26. A tab and a notch assembly for supporting a divider within an interior of a container with respect to sidewalls of the container, said tab formed on a side edge of a plurality of the dividers and said notch formed on a plurality of the sidewalls of the container, the assembly comprising in combination:

said tab rigidly cantilevered from a side edge of one of said dividers, said tab including:

an upper surface parallel to and extending from a top edge of the divider a distance greater than a thickness of the sidewalls, an outside edge extending downward perpendicular to said upper surface, said outside edge being adjacent said upper surface, an overhang defining a surface parallel to said upper surface and spaced from said upper surface a distance equal to a height of said outside edge, said overhang being adjacent said outside edge, and a slope defining a surface oblique with respect to said overhang and said outside edge, said slope extending from a location adjacent said overhang to a location adjacent the side edge of the divider, said slope being closer to said upper surface at said location adjacent said overhang than at said location adjacent the side edge of the divider; and said notch formed in one of the sidewalls, said notch including:

an outside edge of said notch defining contour adjacent an outside surface of the sidewall, said outside edge of said notch having a constant width similar to a thickness of said tab, an inside edge of said notch is defining contour adjacent an inside surface of the sidewall, said inside edge of said notch having a constant width similar to a thickness of said tab, said inside edge of said notch having a length away from a top edge of the sidewall greater than the length of said outside edge of said notch away from the top edge of the sidewall.

27. The assembly of claim 26 wherein a length of said outside edge of said tab is equal to a length of said outside edge of said notch.

28. The assembly of claim 27 wherein said notch includes a slope on a lower portion thereof extending from its outside edge to its inside edge, said slope exhibiting a concave surface.

29. The assembly of claim 28 wherein said overhang has a length similar to a length of said upper surface minus a width of the sidewall.

30. The assembly of claim 29 wherein said slope of said notch includes an uppermost edge defining a junction between said slope and said outside edge of said notch, said uppermost edge configured to remain adjacent said overhang when said sidewall is displaced horizontally away from and toward said divider.

31. The device of claim 30 wherein a length of said overhang is similar to a maximum expansion of said sidewall away from said divider, whereby said uppermost edge remains adjacent said overhang during horizontal translation of said sidewall with respect to said divider due to expansion forces associated with bulging of contents outwardly.

* * * * *